United States Patent [19]

Kauer et al.

[11] 4,242,171

[45] Dec. 30, 1980

[54] SEALING DEVICE FOR SECURING OR SEALING BAGS OR SACKS OF FLEXIBLE MATERIAL

[75] Inventors: Johann Kauer, Bern, Switzerland; Heinz H. Weick, 94, Rue de la Servette, 1202 Geneva, Switzerland

[73] Assignee: Heinz Hermann Weick, Geneve, Switzerland

[21] Appl. No.: 932,368

[22] Filed: Aug. 9, 1978

[30] Foreign Application Priority Data

Aug. 19, 1977 [CH] Switzerland ..... 10237/77

[51] Int. Cl.[3] ..... B65B 13/02

[52] U.S. Cl. ..... 156/485; 53/417; 428/522; 428/577; 428/579

[58] Field of Search ..... 24/30.5 R, 30.5 T; 53/413, 417, 138 A, 583; 156/475–485, 510–522, 579, 577

[56] References Cited

U.S. PATENT DOCUMENTS

| | | | |
|---|---|---|---|
| Re. 28,170 | 9/1974 | Lehmann | 366/238 |
| 2,514,453 | 7/1950 | Miller | 156/522 |
| 2,536,455 | 1/1951 | Miller et al. | 156/522 |
| 3,221,468 | 12/1965 | Casey | 53/417 |
| 4,094,724 | 6/1978 | Sato | 156/510 X |

FOREIGN PATENT DOCUMENTS

| | | |
|---|---|---|
| 666823 | 2/1952 | United Kingdom . |
| 819963 | 9/1959 | United Kingdom . |
| 1305943 | 2/1973 | United Kingdom . |
| 1326462 | 8/1973 | United Kingdom . |

*Primary Examiner*—Henry F. Epstein
*Attorney, Agent, or Firm*—Fleit & Jacobson

[57] ABSTRACT

In a device for securing or sealing a twisted neck portion of a bag or sack of flexible material, a slit is provided in a housing and the latter carries a roll of adhesive tape. The twisted neck is pushed into the slit. A tape guide member, a tape cutter, an actuating arm and a spring loaded arm cooperate to effect the sealing or securing. The housing has a handle near the closed end of the slit.

16 Claims, 5 Drawing Figures

Figure 2:
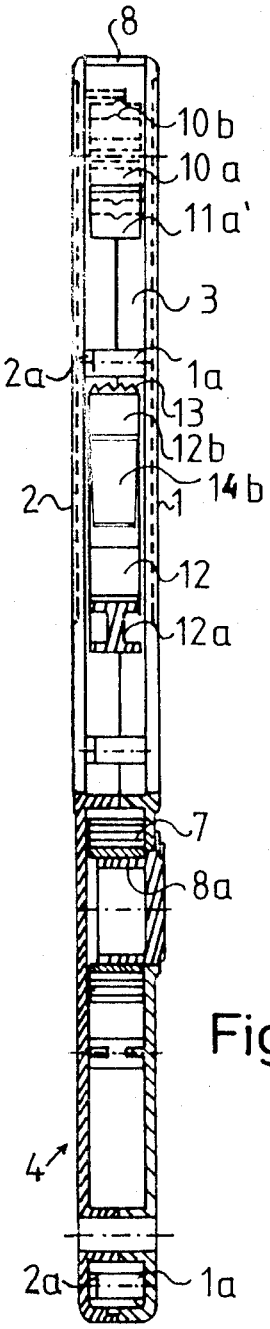

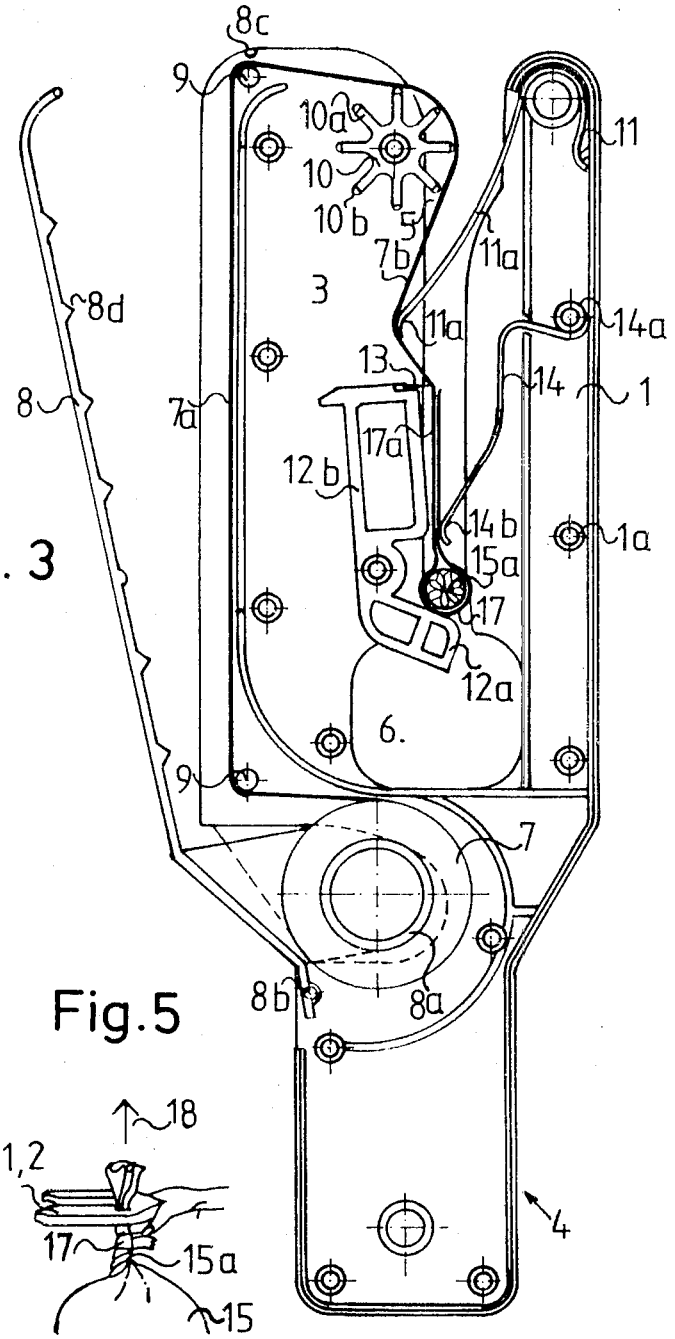
Fig. 3
Fig. 4
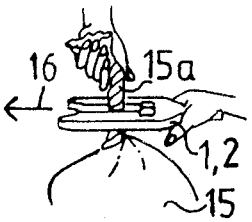
Fig.5

SEALING DEVICE FOR SECURING OR SEALING BAGS OR SACKS OF FLEXIBLE MATERIAL

FIELD OF THE INVENTION

The present invention relates to a device for securing or sealing a twisted neck portion of a bag or sack of flexible material, which can enclose packed goods in the manner of a casing.

PRIOR ART

Such devices have been proposed. One example comprises a housing with a bearing for a roll of adhesive tape, said housing being further provided with a slit for engaging the neck portion of the bag or sack and an exit aperture to the slit for the withdrawal of said neck portion, whereby a tape guide member projecting into the slit is disposed on the one side of the slit in the region of the outer open end of the slit as well as a tape cutting means being mounted nearer to the inner end of the slit for movement in opposition to the force of a spring, said tape cutting means projecting in its normal position by way of an actuating arm into the slit and bearing on a cutting member, which can be moved by the actuating arm towards the slit, a tape cutting blade directed towards the slit, while a spring-loaded arm is secured on the other side of the slit approximately opposite the tape guide member, said arm resting in its normal position against the tape guide member approximately in opposition to the direction of insertion of the neck portion of the bag or sack and thus maintaining adhesive contact with the free end region of the adhesive tape running around the tape guide member. Devices of this kind are made as pedestal devices and serve to seal bags whose twisted necks must be pushed into the slit of the appliance using both hands. The sealing means consists of a loop of adhesive tape, whose free ends are stuck together to form a tail projecting from the sealed neck portion.

SUMMARY OF THE INVENTION

An object of the present invention is to develop a particularly manageable economic method of sealing sacks, i.e., particularly refuse sacks, for which purpose string, metal clips or plastics sealing memmbers to be applied manually have previously been used.

The invention consists of applying the operating principle of the device described at the outset to sealing known sacks which are considerably larger and less manageable than bags, while providing the housing of the device with a handle on its side opposite the outer open end of the slit.

In order to seal a refuse sack, the device in accordance with the invention—in contrast to the previously known bag sealing device, whereby the approximately horizontally aligned neck portion of the bag is guided into the vertical slit of the device from above in a downward direction using both hands—is pushed with one hand in the manner of a beak onto the twisted neck portion of the sack, which is for example standing on the floor, while the other hand simultaneously holds the neck portion to be sealed.

PREFERRED FEATURES OF THE INVENTION

In accordance with a further feature of the invention, the handle extends approximately in the longitudinal direction of the slit thus achieving optimum ease of handling.

In accordance with a further feature of the invention, the exit aperture for the neck portion of the sack is mounted in front of the lower end of the slit in the direction of the handle. In this way, the engaging movement is linear over its entire length and handling is further improved.

A further particularly effective improvement can be seen in the fact that there is disposed in the direction of the handle behind the cutting point of the tape cutting blade a means for additionally pressing together the tail formed by the ends of the adhesive tape sealer. This means consists of two pressing members which are moved towards one another in the manner of tongs and can be moved in relation to one another transversely across the slit.

It is easy to imagine that the twisted neck portion of a sack exerts a relatively great expansion pressure on the adhesive tape loop and tears apart a tail which is not sealed together particularly well. This is prevented by the above-mentioned means which presses together for a second time the tail already formed before the cutting point.

In accordance with a further feature of the invention, the additional pressing means is combined with the cutting means in a surprisingly simple manner.

As a result of single-handed operation it can occur that a clumsy person may move the device upwards or downwards out of the plane of engagement when engaging the device onto the neck portion of the sack. In order to prevent the adhesive tape from thus slipping sideways from the tape guide member, which may for example be in the form of a wheel, this member is provided with small projections on its outer surface which press into the tape.

Further advantageous features of the invention will become apparent from the description of the Figures.

SHORT DESCRIPTION OF THE DRAWINGS

Figure 1:
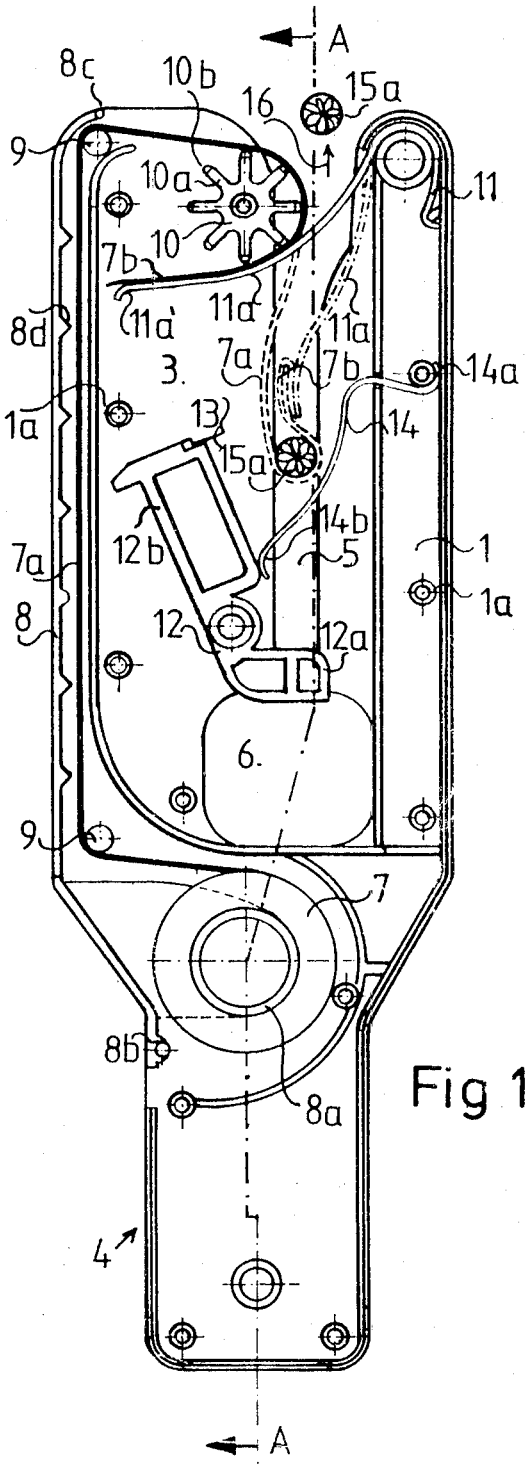

An illustrative and non-limiting embodiment of the invention is illustrated in the drawings in which:

FIG. 1 is a plan view of the opened device with the individual operating members in the normal position, FIG. 2 is a section taken along the line A—A according to FIG. 1, FIG. 3 shows the opened device according to FIG. 1 during the cutting process, FIG. 4 shows the device being engaged on the neck portion of a sack (in perspective view) and FIG. 5 shows the device being removed from the neck portion of the sack (in perspective view).

DESCRIPTION OF A PARTICULAR EMBODIMENT

The housing consists of two dish-shaped plates 1, 2, whereby pins 2*a* engage in wooden pins 1*a* in order to secure said plates to one another. Below the region enclosing the operating area 3 the plates 1, 2 taper into a handle 4. An insertion slit 5 extending through the operating area 3 in the direction of the handle 4 is open on its side opposite the handle 4 and opens at its other end into the exit aperture 6. A roll of adhesive tape 7 is pivotally mounted in the transition region between the operating chamber 3 and the handle 4, whereby the mounting 8*a* is formed onto a strip-shaped arm 8 which can be swung out around the point of rotation 8*b* and locks into position at the point 8*c*. In order to minimize the electrostatic charging of the adhesive tape 7a in relation to the housing 1, 2 and the resultant adhesion or frictional resistance of the tape in respect of its passage in the housing, the adhesive tape 7a is guided from the roll 7 virtually in free suspension over the pivotally mounted guide rollers 9. In the opening region of the insertion slit 5, the adhesive tape embraces a toothed tape guide wheel 10 which is likewise pivotally mounted. The side of the tape with the adhesive surface faces outwards and is prevented from making unwanted adhesive contact by the strip-shaped arm 8 provided with transverse fins 8d on its inner surface, said arm being swung outwards when a roll of adhesive tape 7 is to be replaced.

On the side of the slit opposite this guide wheel 10 there is located substantially at the same height a flat coil spring 11, whose free limb 11a, being gently curved towards the tape guide wheel 10, abuts in its resting position (FIG. 1) under pressure with the tape guide wheel 10 and thereby maintains adhesive contact with the end region 7b of the adhesive tape 7a. The end of the spring limb 11a bends gently downwards and tapers conically.

The tape cutting means consists primarily of the pivotally mounted angle lever 12. The actuating arm 12a projects into the slit 5 while the cutting arm 12b, which rests in its normal position (FIG. 1) to the side of the slit 5, carries a tape cutting blade 13 directed towards the slit 5. In this position, pressure is exerted upon the angle lever 12 by a second flat coil spring 14, which extends from its fixed end 14a transversely through the slit 5 and abuts by way of its free end region 14b which is curved and tapers conically, with the cutting arm 12b. The mutual arrangement and the co-operation of the cutting arm 12b and the flat coil spring 14 are such that—as can be seen from the following description of the method of operation—these two members simultaneously represent a means for additionally pressing together the tail formed by the ends of the adhesive tape sealer.

In order to seal, for example, a full refuse sack 15 the opening region of this sack is twisted into a neck portion 15a, the end of which is held firmly in one hand. The other hand engages the device laterally on the neck portion 15a in the direction of the arrow 16 in FIG. 4, so that the neck portion passes through the entire length of the insertion slit 5 of the device and reaches the exit aperture 6. As the neck portion 15a passes through the slit 5 of the device in this way the adhesive tape sealer 17 is applied to the neck portion in accordance with the method of operation of the device as described below. The device is then lifted off the neck portion 15a in the direction of the arrow 18 shown in FIG. 5.

As the device is engaged with the neck portion 15a of the sack in the direction of the arrow 16 shown in FIG. 1, the neck portion 15a first reaches a position between the toothed tape guide wheel 10 and the limb 11a of the flat coil spring. The teeth 10a effect a first intensive adhesive contact between the adhesive tape 7a and the neck portion 15a. As the neck portion 15a slides more deeply into the slit 5 the limb is bent back, whereby at the same time the adhesive tape 7a on the one hand is pulled along over the tape guide wheel 10 and on the other hand the tape region 7b adhering to the spring limb 11a is pulled off, whereby the adhesive tape wraps itself in a loop around the neck portion 15a. This phase of the operation is shown in FIG. 1 by the broken lines. After the neck portion 15a of the sack has passed the ends of the spring limb 11a, the limb primarily jerks slightly in the direction of its normal position and thus presses together the two portions of the tape 7a, 7b, facing upwards from the neck portion 15a. According to the phase of the operation shown in FIG. 3, the neck portion 15a then abuts with the actuating arm 12a of the cutting means and, together with the arm 12a, pivots the cutting arm 12b towards the slit 5. The blade 13 severs the tape, whereafter the spring limb 11a jerks back into its original position while simultaneously establishing a new adhesive contact with the tape region 7b. The curved end 11a of the spring limb 11a effects a better pressing action while the conical tapering of the said end prevents the limb 11a from catching on the corresponding edges of the slit when it springs back.

The spring limb 11a is of such length that the tape is severed directly underneath its end 11a, thereby producing a double tail 17a sealed together along its entire length.

As can also be seen from FIG. 3, the neck portion 15a must also pass the end region 14b of the flat coil spring 14 of the cutting means shortly before the cutting phase, whereby the spring 14 is bent back and exerts an advantageous pressure on the adhesive tape loop 17. The spring 14 then jerks back when the cutting arm 12b has already been pivoted into the cutting position. In this way, the tape tail 17a is squeezed in between the end 14b of the spring and the corresponding point on the cutting arm 12b almost directly above the neck portion 15a and its entire length is then pulled through this tong-like passage. This ensures that the tail 17a is well sealed by the repeated application of pressure, where possible right from the neck portion 15a outwards and right to its end, and thus withstands the expansion pressure of the neck portion 15a with certainty. The cutting arm 12b and its restoring flat coil spring 14 thus act as an additional pressure means for the tail 17a due to their special construction and mutual disposition. The curved end 14b of the flat coil spring is in turn conically tapered in order to prevent it from catching on the corresponding edges of the slit. When the neck portion 15a has reached the exit aperture 6 at the end of its completely linear engaging movement, i.e., without altering the direction of movement, the device is easily lifted off upwardly (in the direction of arrow 18)—as previously described with reference to FIG. 5.

It is conceivable that, in the event of clumsy operation, the device may be moved out of its plane of movement while being engaged on the neck portion 15a. This leads to the risk of the adhesive tape 7a sliding laterally from the tape guide wheel 10. This would then involve unnecessary effort to render the device operational once more by correctly guiding the tape into position. In order to avoid to a large extent a possible disturbance of this kind, small projecting cams 10b are formed onto the edges of the teeth 10a of the tape guiding wheel 10, said cams pressing into the tape 7a and considerably increasing the slide resistance.

The toothed construction of the guide wheel 10 certainly increases the first adhesive contact between the tape 17 and the neck portion 15a of the sack to be sealed, it is not however absolutely necessary. The projections 10b may also be formed in various ways onto the casing surface of an untoothed guide wheel. To the same end the casing surface could be of a gentle roof-shaped or trough-shaped construction.

In respect of the tape cutting and/pressing means for the sealer tail it is possible to construct at least one element in the form of a slider.

Naturally, the device in accordance with the invention may also be used to seal bags. In this instance, the handle region 4 may be supported for example against the operator's chest in order to leave both hands free to insert the neck portion of the bag. For the same purpose it is possible to locate the device, for example by way of its handle 4, in a separate table stand thus additionally providing an ease of handling similar to that provided by the known bag sealing devices.

I claim:

1. A device for securing with an adhesive tape a twisted neck portion of a bag or sack of flexible material, the device comprising:

(a) an elongated housing, (b) a mounting carried by the housing and being arranged for supporting a roll of adhesive tape, (c) walls forming part of the housing and defining a slit having an open end and a closed end and which extends generally longitudinally of the housing, the walls also defining an exit opening at the inner end of the slit, the exit opening being located to permit removal of the neck portion after application of the tape thereto, (d) a tape guide member carried by the housing on one side of the slit, (e) a tape severing means carried by the housing for movement relative thereto and located in the region of the inner end of the slit, (f) a tape cutter provided by the tape severing means, (g) a spring biassing means carried by the housing and engaging the tape severing means, and mounted to spring bias the tape cutter away from the slit except when an actuating arm of the tape severing means is engaged by the neck portion, (h) a spring loaded arm carried by the housing and located on the opposite side of the slit to the tape guide member, the said arm in a normal position thereof extending across the slit and being adjacent to the tape guide member, the said arm being located to maintain an adhesive contact with a free end portion of a tape passing round the tape guide member, and (i) the housing having an elongated U-shaped portion defining the slit and an elongated extension portion below the exit opening of the slit, said extension portion extending substantially in the longitudinal direction of the slit and forming a handle for the device.

2. A device in accordance with claim 1, wherein said mounting is disposed in the housing in a region defining a junction between said U-shaped portion and said extension portion.

3. A device in accordance with claim 1, including a means for effecting an additional pressing together of a sealing tail formed by adhesively-joined parts of the tape, said means being disposed nearer to the handle than the point at which the tape cutter cuts the tape, said means comprising two pressing members which are resiliently pressed towards one another in a tong-like manner and may be moved in relation to one another transversely of the slit.

4. A device in accordance with claim 3, wherein one of the two pressing members is a flat springy strip which is secured to the housing on the side of the slit opposite to the tape cutter, and the other of the pressing members is constituted by a movably mounted member which carries the tape cutter.

5. A device in accordance with claim 1, wherein the mounting for the roll of adhesive tape is disposed on a portion of the housing which is swingable in a direction laterally of the slit relative to the remainder of the housing.

6. A device in accordance with claim 1 including a side wall of the housing having fins which are positioned and constructed to guide in a substantially non-adhesive fashion the tape in its path from the mounting to the tape guide member.

7. A device in accordance with claim 5 wherein the swingable portion of the housing has fins which are positioned and constructed to guide in a substantially non-adhesive fashion the tape in its path from the mounting to the tape guide member.

8. A device in accordance with claim 1, wherein the tape guide member has relatively sharp projections designed to prevent the adhesive tape from sliding in a direction parallel to the axis of the tape guide member.

9. A device in accordance with claim 1, wherein the said spring loaded arm is constituted by a flat springy strip and wherein said springy strip has a free end region in the form of a gently tapered curve directed away from the tape guide member.

10. A device for securing with an adhesive tape a twisted neck portion of a bag or sack of flexible material, the device comprising:

(a) an elongated housing, (b) a mounting carried by the housing and being arranged for supporting a roll of adhesive tape, (c) walls forming part of the housing and defining a slit having an open end and a closed end and which extends generally longitudinally of the housing, the walls also defining an exit opening at the inner end of the slit, the exit opening being located to permit removal of the neck portion after application of the tape thereto, (d) a tape guide member carried by the housing on one side of the slit, (e) a tape severing means carried by the housing for pivotal movement relative thereto and located in the region of the inner end of the slit, (f) a tape cutter provided by the tape severing means, (g) a spring biassing means carried by the housing and engaging the tape severing means, and mounted to spring bias the tape cutter pivotally away from the slit except when an actuating arm of the tape severing means is engaged by the neck portion, (h) a spring loaded arm carried by the housing and located on the opposite side of the slit to the tape guide member, the said arm in a normal position thereof extending across the slit and being adjacent to the tape guide member, the said arm being located to maintain an adhesive contact with a free end portion of a tape passing round the tape guide member, (i) the housing having an elongated U-shaped portion defining the slit, an elongated extension portion below the exit opening of the slit, said extension portion extending substantially in the longitudinal direction of the slit and forming a handle for the device and a tapered junction portion joining said U-shaped portion and said extension portion, said mounting being located in said junction portion and said housing further including means defining a tape guide path extending from said mounting to said tape guide member.

11. A device in accordance with claim 10, including a means for effecting an additional pressing together of a sealing tail formed by adhesively-joined parts of the tape, said means being disposed nearer to the handle than the point at which the tape cutter cuts the tape, said means comprising two pressing members which are resiliently pressed towards one another in a tong-like manner and may be moved in relation to one another transversely of the slit.

12. A device in accordance with claim 11, wherein one of the two pressing members is a flat springy strip which is secured to the housing on the side of the slit opposite to the tape cutter, and the other of the pressing members is constituted by a movably mounted member which carries the tape cutter.

13. A device in accordance with claim 10, wherein the mounting for the roll of adhesive tape is disposed on a portion of the housing which is swingable in a direction laterally of the slit relative to the remainder of the housing.

14. A device in accordance with claim 10 including a side wall of the housing having fins which are positioned and constructed to guide in a substantially non-adhesive fashion the tape in its path from the mounting to the tape guide member.

15. A device in accordance with claim 13 wherein the swingable portion of the housing has fins which are positioned and constructed to guide in a substantially non-adhesive fashion the tape in its path from the mounting to the tape guide member.

16. A device in accordance with claim 10, wherein the tape guide member has relatively sharp projections designed to prevent the adhesive tape from sliding in a direction parallel to the axis of the tape guide member.

* * * * *